US005415607A

United States Patent [19]

Carpenter

[11] Patent Number: 5,415,607

[45] Date of Patent: May 16, 1995

[54] EXERCISE DEVICE

[75] Inventor: David P. Carpenter, Dunkirk, Md.

[73] Assignee: M. Michael Carpenter, Los Angeles, Calif.

[21] Appl. No.: 125,751

[22] Filed: Sep. 24, 1993

[51] Int. Cl.[6] ..... A63B 21/072

[52] U.S. Cl. ..... 482/106; 482/107; 482/108; 482/50

[58] Field of Search ..... 482/92, 93, 104–108, 482/49, 50, 109; 74/551.1, 551.2, 551.6–551.9

[56] References Cited

U.S. PATENT DOCUMENTS

| | | | |
|---|---|---|---|
| 4,531,728 | 7/1985 | Wright | 482/106 |
| 4,639,979 | 2/1987 | Polson | 482/107 |
| 4,743,017 | 5/1988 | Jaeger | 482/108 |
| 4,971,318 | 11/1990 | Tracy | 482/107 |

FOREIGN PATENT DOCUMENTS

| | | | |
|---|---|---|---|
| 14535 | 2/1908 | Germany | 74/551.9 |
| 802134 | 2/1951 | Germany | 74/551.9 |

*Primary Examiner*—Stephen R. Crow
*Assistant Examiner*—Glenn E. Richman
*Attorney, Agent, or Firm*—M. Michael Carpenter

[57] ABSTRACT

An exercise device is shown formed from a weight having a C-shaped cross-section with an inner diameter large enough to fit over and at least partially about the bar of a dumbbell. In the preferred embodiment, a pair of weights are joined by a hinge to permit them to open about the bar and to then close upon it.

12 Claims, 3 Drawing Sheets

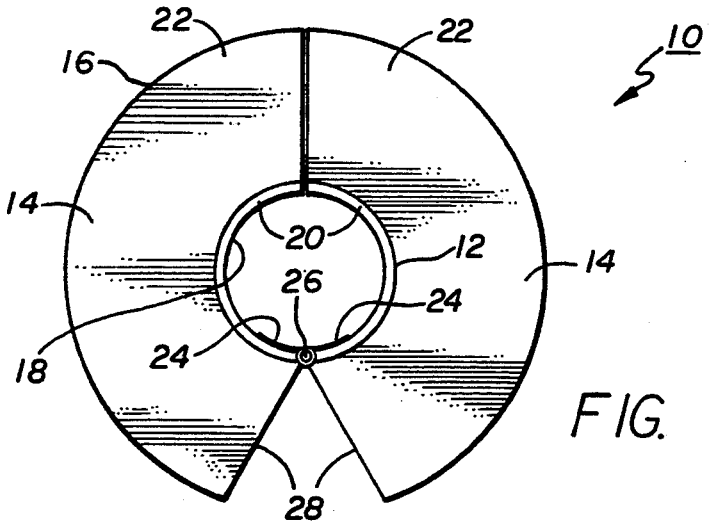
FIG. 1
FIG. 2
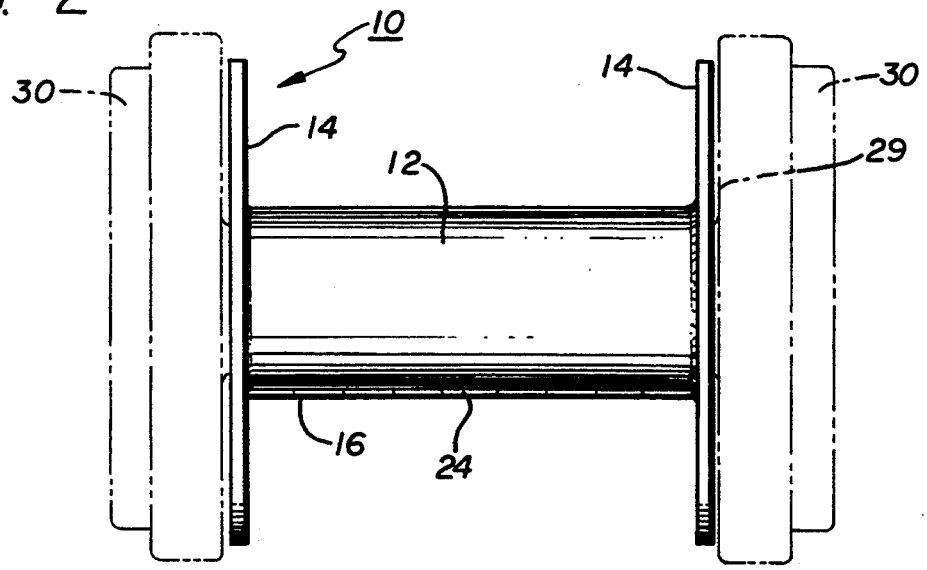
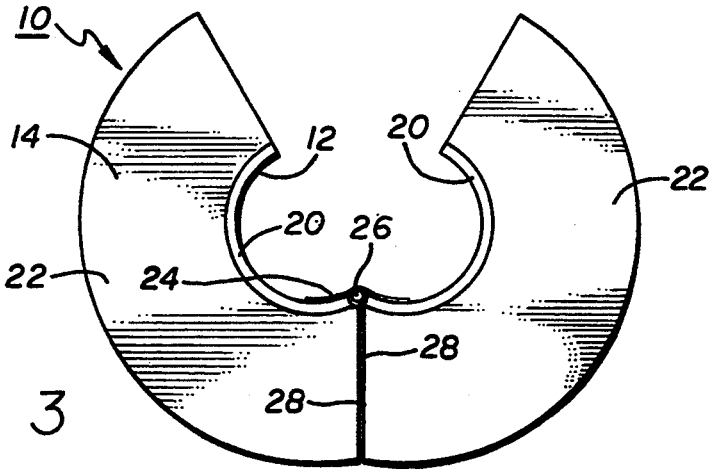
FIG. 3

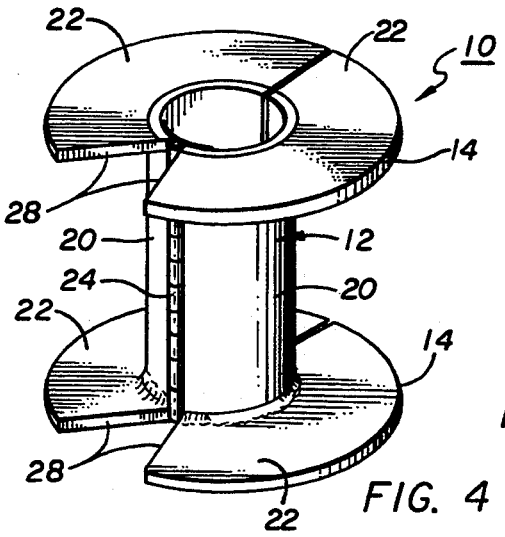
FIG. 4
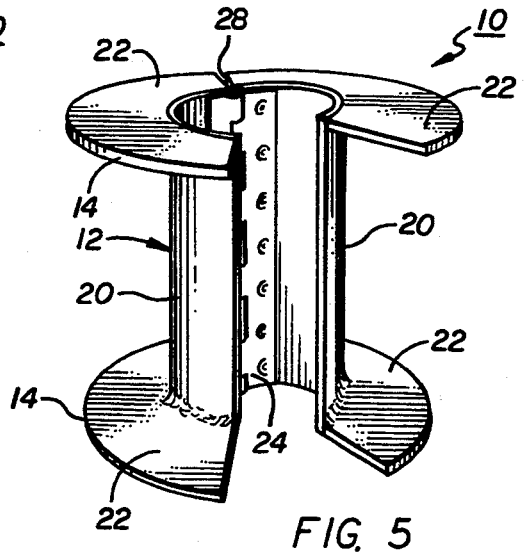
FIG. 5
FIG. 6
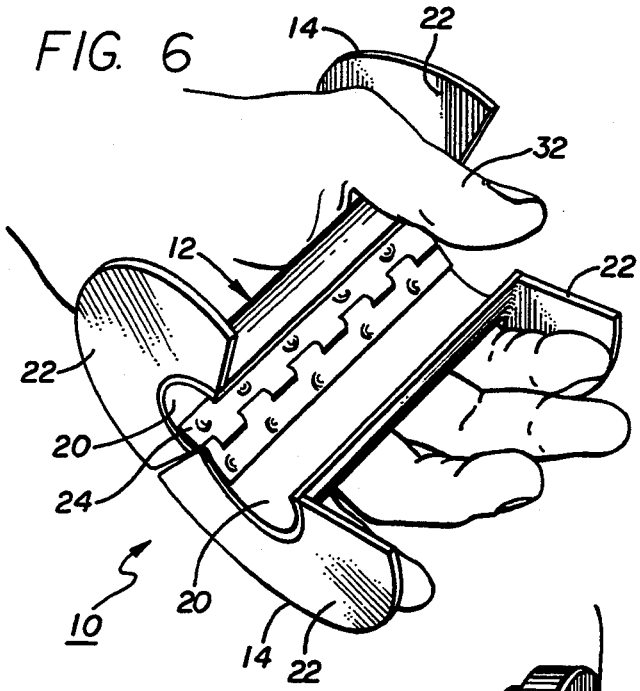
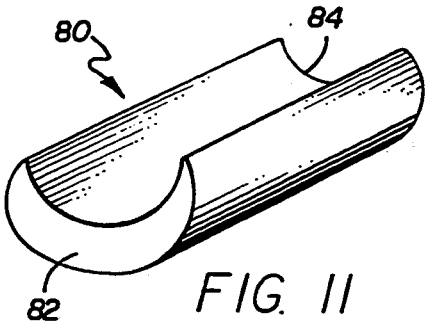
FIG. 11
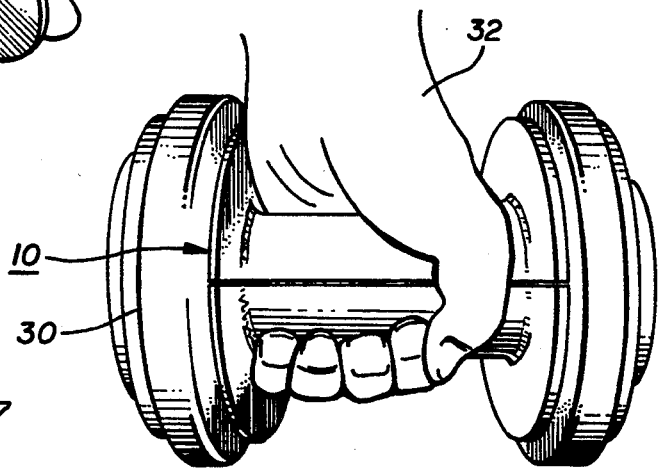
FIG. 7

EXERCISE DEVICE

BACKGROUND OF THE INVENTION

The present invention relates to an exercise device and, more particularly, to an exercise device that may be used with dumbbells.

The use of weights to enhance calisthenic exercise is well known. Barbells, consisting of a bar with weighted disks at each end which may be adjusted to increase or decrease the weight of the bar, are used to exercise the legs, back and shoulders of the user. Such exercises as the clean and jerk, the snatch and the press using a barbell are part of Olympic competition in which Olympic records are broken by fractions of a pound. Dumbbells are used to exercise the arm muscles and, like the larger barbell, consist of a shorter bar with two identical spheres formed on each end as a solid cast dumbbell or with adjustable weighted disks attached to each end.

The dumbbells with adjustable weights on each end are generally sold for an individual's home use. Most commercial or club gymnasiums use either the solid dumbbell or a fixed dumbbell having its weighted disks permanently attached by welding. In gymnasiums, it is not desirable to have adjustable dumbbells, as the need to change weights four times (twice for each dumbbell) is time consuming, creates a clutter of small weighted disks about the gym, and can be dangerous if one of the four changes is not properly done causing a weight to fall off in use. Another problem with dumbbells for the average commercial or club gymnasium is that a rack of forty dumbbells from five to one hundred pounds is expensive and space consuming.

The average user is far below the level of Olympic competition mentioned above. An average user will use a pair of dumbbells weighing five, ten, fifteen and up to fifty pounds each, while some may use dumbbells up to one hundred or two hundred pounds each. The heavier dumbbell weights may be used to exercise the biceps and shoulders with the elbows close to the user's side. However, when a user extends his or her arms, the amount of weight that can be lifted drops dramatically.

SUMMARY OF THE INVENTION

When using dumbbells at arm's length, it is often difficult for a user to increase the weight being lifted from a fifteen pound to a twenty pound dumbbell, for example. As most dumbbells are provided in increasing five-pound increments, such a weight jump is required, even if it is difficult.

Accordingly, an object of the present invention is to provide an exercise device that will make the normal five-pound increase in dumbbell selection unnecessary.

Another object of the invention is to make it easier for the user of a set of dumbbells to increase the weight he or she is using in smaller increments.

Yet another object is to provide an exercise device that will permit a full set of forty dumbbells, two each from five to one hundred pounds, for example, to become more flexible with a wider range of weight resistance for the user without increasing the need for more dumbbells or more space to store them.

To accomplish these and other objects, an exercise device is formed from a weight having a C-shaped cross-section with an inner diameter large enough to fit over and at least partially about the bar of a dumbbell. In the preferred embodiment, a pair of weights are joined by a hinge which permits them to open and then to close upon the dumbbell bar.

DRAWINGS

Other objects and advantages and a better understanding of the exercise device of the present invention will become apparent after reference to the specification and the accompanying drawings, wherein:

FIG. 1 is an end view of the exercise device of the present invention;

FIG. 2 is a side view of the exercise device, showing a dumbbell in phantom;

FIG. 3 is an end view of the device, similar to that shown in FIG. 1, in an opened position;

FIG. 4 is a perspective view of the exercise device in a closed position;

FIG. 5 is a perspective view of the exercise device, similar to FIG. 4, shown in an opened position;

FIG. 6 shows the exercise device in a user's hand in an opened position;

FIG. 7 shows the exercise device closed between the weights of a dumbbell in a user's hand;

FIG. 11 is a perspective view of the simplest embodiment of the exercise device.

DESCRIPTION OF THE PREFERRED EMBODIMENT

Figure 9:
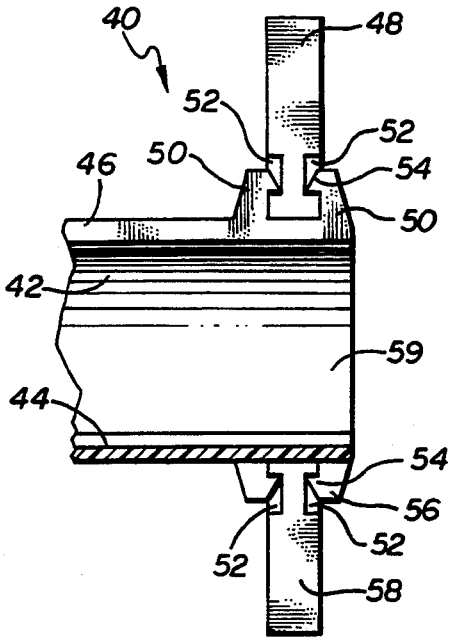
FIG. 9 is a partial side view of the exercise device in cross-section along lines 9—9 of FIG. 8.

Referring now to the drawings, FIGS. 1 and 2 show an exercise device 10 having a hand grip bar, formed from a cylinder or tube 12, with a rim or flange 14 attached at each end. The cylinder or tube 12 and attached rim or flange 14 form a spool 16 with an axial opening 18. The spool 16 is cut in half along its longitudinal axis forming the tube 12 into two semicircular halves 20 and each flange 14 into a pair of C-shaped halves 22.

Each semicircular half 22 of tube 12 is joined along one longitudinal edge by a hinge 24, such as a piano hinge, which may be attached to the semicircular halves by welding, such as spot welding. The piano hinge pivots about a pin 26, as is well known. In the embodiment shown in FIGS. 1 to 7, the tube 12, flanges 14 and hinge 24 are made from a suitable steel that lends itself to welding, for example, spot welding to join the hinge and fillet welding to join the flanges. Other materials are also possible, as will be discussed below.

As seen in FIG. 1, each C-shaped half flange 22 is relieved at 28. The relief is formed by a cut in the flange shaped like a sector or a wedge. This relief 28 permits the spool 16 to open, as best seen in FIG. 3, while limiting the opening to just fit about a bar 29 of a dumbbell 30 shown in phantom in FIG. 2.

FIGS. 4 and 5 show the exercise device 10 in its closed and open positions, respectively. Similarly, FIGS. 6 and 7 show the exercise device 10 in its respective open and closed position as held by a user's hand 32. FIG. 6 illustrates how the weight of the flanges 14 when split into C-shaped halves 22 urges the tube 12 to open about hinge 24 to permit the semicircular halves 20 of the tube 12 to fit over and about the bar 29 of dumbbell 30 and to close upon the bar 29, as seen in FIG. 7. In the arrangement shown, the exercise device 10 fits between the weights of dumbbell 30 to maintain its balance.

Figure 8:
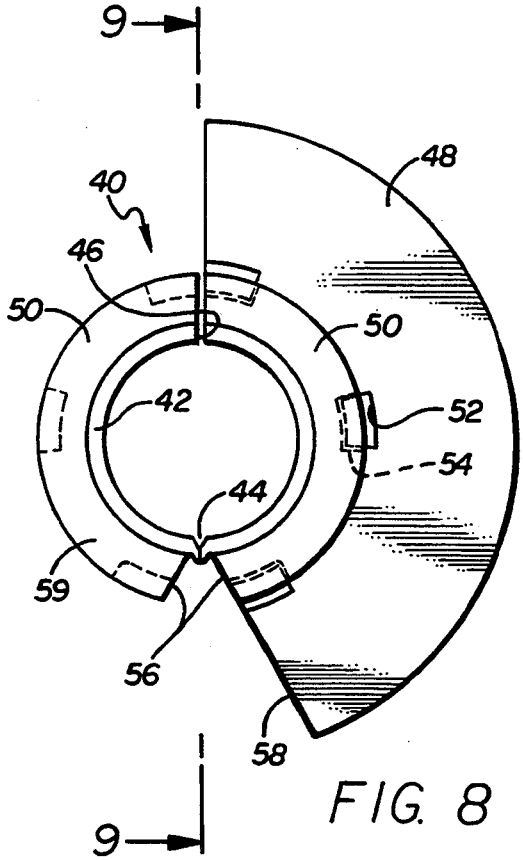
FIG. 8 is an end view of a second embodiment of the exercise device with a single weight inserted between the flanges.

Referring to FIGS. 8 and 9, a second embodiment of the exercise device 40 is shown. In place of a steel tube 12, a suitable plastic tube 42 may be used with a longitudinal groove 44 in one side of the tube 180 degrees opposite from a longitudinal split 46 in the other side. The thinner grooved cross-section 44 will serve as a hinge thus eliminating the need for a separate hinge 24. The flanges 14 are formed from suitable C-shaped disks 48 that may be force-fitted into grooves (not shown) about the outer ends of the plastic tube 42 or between a pair of parallel flanges 50 on each end of the tube. In place of a force-fit, the C-shaped disks 48 may have indentations 52 in the surfaces thereof which fit between the parallel flanges 50 to receive suitable tabs 54 molded into the inner surfaces of the flanges 50. The assembled tube 42 and disks 48 thus form a spool 59. The flanges 50 and C-shaped disks 48 are each provided with a sector or wedge relief 56 and 58, respectively, to permit the exercise device 40 to be opened to a limited degree.

The exercise device of FIGS. 8 and 9 may also be formed either by 1) molding or otherwise forming the spool 59 as a single piece which may then be cut in half along its longitudinal axis or by 2) simply molding half of the spool 59 as a single piece. In the example where a cut is made, relief sectors 56 and 58 would be added as that cut is made. In the example where a molded half is used, the relief sectors 56 and 58 may be added to the mold. Whichever process of manufacture is used, the two half pieces may then be joined by a hinge created from a joining strip of material, such as a rubber strip, a plastic strip or a strip of tape sold under the trademark "Velcro." However the hinge is formed, the strip may be joined to the tube 42 by chemical bonding.

The exercise device of FIGS. 8 and 9 may also be formed by use of a plastic tube 42 having a single flange 50 at each end thereof. The tube 42 and flanges 50 may then be split and an appropriate relief 56 added. The C-shaped disks 48 may then be attached to flange 50, as by chemical bonding. A strip hinge, shown only as a groove 44 in FIGS. 8 and 9, formed from rubber, plastic or tape sold under the trademark "Velcro," may then be attached by chemical bonding. Clearly there are several ways to form the exercise devices shown at 10 and 40 of FIGS. 1 to 9 and the present invention should be limited only by the appended claims.

Figure 10:
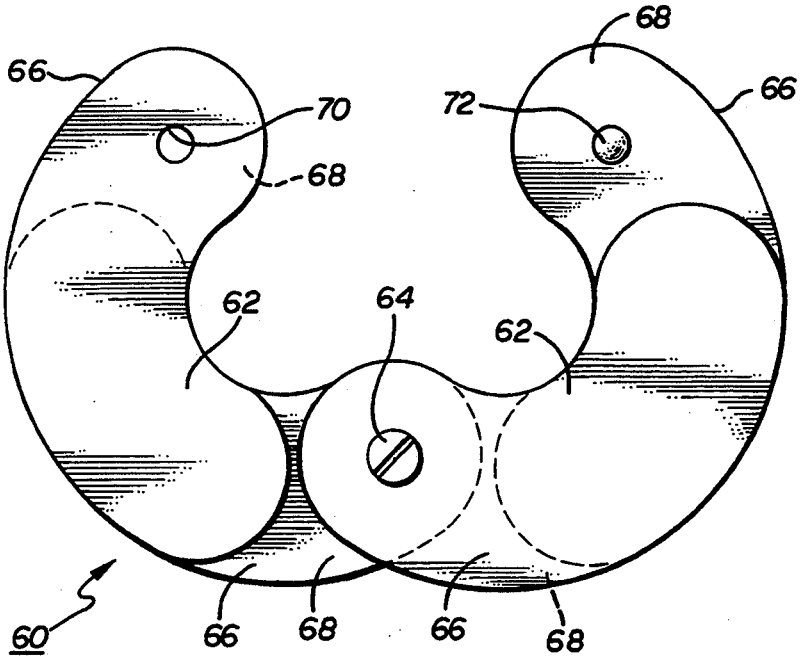
FIG. 10 is a top plan view of a further embodiment of the exercise device.

FIG. 10 shows a further embodiment wherein the cylinder or tube 12 of the spool 16 can be eliminated to form an exercise device 60. The device 60 has a pair of C-shaped disks 62 joined at a hinge 64 formed by a metal screw, for example, for connecting the disks 62 into a clamp-like device. This resulting device may be opened to fit over the dumbbell bar 29 and then closed upon the bar. One pair of joined C-shaped disks may be used on each dumbbell 30 at but one end of the dumbbell bar, by the user's thumb or the heel of his or her hand. This arrangement has an advantage of fewer parts but the disadvantage of unbalancing the dumbbell.

The pair of C-shaped disks 62 may be formed by four nearly identical C-shaped elements 66 with each C-shaped disk formed by two elements connected in an off-set manner, as seen in FIG. 10, to provide flats 68 on each end and on opposite sides of each C-shaped disk. The flats 68 permit two C-shaped disks 62 to retain a flat profile when the two are joined at one end by the metal screw to form the hinge 64. The opposite ends of the disks 62 overlap when closed so that an aperture 70 on one flat 68 receives a raised detent on the opposing flat to close and lock the exercise device 60 upon the bar 29 of a dumbbell 30.

A last, and simplest, embodiment of the present invention is shown in FIG. 11. Here an exercise device 80 is formed from a single weight 82 having a C-shaped cross-section which, in this embodiment, has tapered ends to form a crescent-shaped cross-section. The C-shape or crescent shape has an inner diameter 84 large enough to fit over and about the bar 29 of a dumbbell 30. The length of the arc formed by diameter 84 need not be long enough to surround 180° of the bar. In fact, less than 90° will be sufficient so long as the C-shape permits the user's hand 32 to comfortably hold the device 80 against the bar 29 during use. The device will fit between the weights at each end of the dumbbell 30 and, unlike the device 60 of FIG. 10, will maintain the balance of the dumbbell.

The embodiments of the exercise devices 10, 40, 60 or 80 discussed above preferably weigh two and one-half pounds each. Thus, a user may increase the weight of his or her dumbbell 30 from fifteen to seventeen and one-half pounds, instead of from fifteen to twenty pounds, for example. Other weights for the exercise device are possible, such as one and a quarter or three and a three quarter pounds.

In FIGS. 1 to 7, the distance between the outer surfaces of the rims or flange 14 exercise device 10 may vary, but four and one-half to four and five-eighths inches is acceptable. The rim or flange diameters may also vary between five to six inches, while the inner diameter of the cylinder or tube 12 may be one and one-half inches. Relief 28 in each flange 12 should be approximately fifteen degrees to permit an opening of the device 10 of approximately forty-five degrees. The device 40 of FIGS. 8 and 9 may have similar dimensions, while devices 60 and 80 of FIGS. 10 and 11 may have the dimensions suggested for the inner diameter of tube 12.

As stated above, materials other than steel or plastic may be used to create an easily fabricated exercise device. Welding or chemical bonding may be used, and the hinge may be fabricated from a groove, steel, rubber, plastic or a material sold under the trademark "Velcro." Within the foregoing teachings, it will be clear that other modifications are possible and that the present invention should be limited only by the appended claims.

I claim:

1. An exercise device for use with a dumbbell, said dumbbell having a bar with weighted disks at each end thereof, comprising:

a weight having a generally C-shaped cross-section;

said C-shaped cross-section of said weight having an inner diameter suitable to fit over and at least partially about said bar of said dumbbell:

said weight including two pair of generally C-shaped disks:

a split tubular cylinder having longitudinal edges connected between said two pair of said C-shaped disks; and a hinge joining said split tubular cylinder at one longitudinal edge thereof to permit said joined tubular cylinder and connected C-shaped disks to open to fit over said bar and to close upon said bar.

2. An exercise device, as claimed in claim 1, wherein: said tubular cylinder is a metal tube and said hinge is attached thereto as by welding.

3. An exercise device, as claimed in claim 1, wherein: said tubular cylinder is a plastic tube and said hinge is formed by a relief groove therein.

4. An exercise device for use with dumbbell weights, comprising:

a hand grip tube portion having a longitudinal axis and discrete ends, said hand grip tube separated along said axis into two semicircular halves;

a hinge joining said semicircular halves along one of said separations;

a pair of weighted flanges each separated into C-shaped halves; and said C-shaped halves each joined to a discrete end of said semicircular halves; wherein the weight of said flanges urges said flanges and said hand grip tube into an open position to fit upon said dumbbell.

5. An exercise device, as claimed in claim 4, wherein: said hinge is a piano hinge; and said hinge is joined to said semicircular halves by welding.

6. An exercise device, as claimed in claim 4, wherein: said C-shaped shaped flange halves are joined to said semicircular halves by welding.

7. An exercise device, as claimed in claim 4, wherein: said C-shaped shaped flange halves are relieved at said hinge to permit a limited opening of said semicircular tube halves.

8. An exercise device for use with dumbbells, comprising:

a spool including a cylindrical tube and weighted rims at each end;

said spool and rims separated to form two semicircular counterparts;

a hinge; and said semicircular counterparts joined along one separation in said cylindrical tube by said hinge wherein the weight of said rims urges said rims and said separated tube into an open position to fit upon said dumbbell.

9. An exercise device, as claimed in claim 8, wherein: said rim at each end of said cylinder is relieved at a point next to the joining of said cylindrical tube to limit the opening of said spool.

10. An exercise device, as claimed in claim 9, wherein:

said rim at each end of said cylindrical tube is attached thereto by welding; and said hinge is attached to said semicircular counterparts by welding.

11. An exercise device, as claimed in claim 8, wherein:

said hinge joining said cylindrical tube separated to form said semicircular counterparts is formed by a longitudinal groove along one side of said tube opposite a slit in the other side which forms said separation; and said rim is formed by C-shaped disks mounted upon each end of said semicircular tube.

12. An exercise device, as claimed in claim 11, wherein:

said semicircular tube includes parallel flanges on each end to receive said C-shaped disks;

said flanges have inwardly extending tabs; and said C-shaped disks have indentations to receive said inwardly extending tabs to secure said C-shaped disks between said parallel flanges and to said semicircular tube.

* * * * *